US007264190B2

(12) United States Patent
Smith et al.

(10) Patent No.: US 7,264,190 B2
(45) Date of Patent: Sep. 4, 2007

(54) MATERIAL BREAKER SYSTEM

(75) Inventors: Roger G. Smith, Lake Oswego, OR (US); Jason D. Gerard, Sandy, OR (US)

(73) Assignee: Construction Equipment Company, Lake Grove, OR (US)

( * ) Notice: Subject to any disclaimer, the term of this patent is extended or adjusted under 35 U.S.C. 154(b) by 234 days.

(21) Appl. No.: 11/175,632

(22) Filed: Jul. 5, 2005

(65) Prior Publication Data

US 2007/0007374 A1 Jan. 11, 2007

(51) Int. Cl.
*B02C 21/02* (2006.01)

(52) U.S. Cl. ..... 241/101.74; 241/270; 241/283

(58) Field of Classification Search ..... 241/283, 241/270, 271, 101.74–101.76
See application file for complete search history.

(56) References Cited

U.S. PATENT DOCUMENTS 1,291,895 A * 1/1919 Howlett ..... 241/283
3,563,477 A 2/1971 Schroeder et al.
3,670,971 A * 6/1972 Schneider ..... 241/69
3,927,839 A 12/1975 Quinn
4,383,651 A * 5/1983 Couperus ..... 241/81
4,512,524 A 4/1985 Shigemizu
4,562,974 A * 1/1986 Bezette et al. ..... 241/283
4,585,179 A 4/1986 Tsuji et al.
4,598,875 A 7/1986 Bronson et al.
4,655,402 A 4/1987 Desourdy
4,795,103 A 1/1989 Lech
4,838,493 A 6/1989 LaBounty
4,881,691 A 11/1989 Oldengott et al.
4,903,902 A * 2/1990 Hufnagel ..... 241/84
4,951,885 A 8/1990 Thüs
4,951,886 A 8/1990 Berto
5,026,205 A 6/1991 Gorski et al.
5,161,744 A 11/1992 Schoop et al.
D332,791 S 1/1993 Kanzawa
5,234,564 A 8/1993 Smith
5,234,608 A 8/1993 Duff
5,301,882 A 4/1994 Morikawa et al.
5,647,545 A 7/1997 Conner
5,704,560 A 1/1998 Wimmer
5,743,476 A 4/1998 Morikawa et al.
5,762,446 A 6/1998 Manatt et al.
5,878,967 A 3/1999 Conner
5,887,810 A 3/1999 Maruyama
5,921,706 A 7/1999 Manatt et al.
6,009,802 A 1/2000 Schaaf et al.

(Continued)

*Primary Examiner*—Mark Rosenbaum
(74) *Attorney, Agent, or Firm*—Kolisch Hartwell, P.C.

(57) ABSTRACT

A vehicle for breaking material is disclosed. The vehicle includes: an elongate vehicle frame; a feeder having a feed end portion and a discharge end portion, wherein the feeder is configured to convey the material from the feed end portion to the discharge end portion; and a material breaker supported via the vehicle frame with a feed end portion that is downstream from the discharge end portion of the feeder. The material breaker includes: a platform configured to support the material received from the feeder, at least one breaker element configured to move towards the platform and contact at least a portion of the material received from the feeder and supported by the platform, wherein movement of the at least one breaker element towards the platform is assisted, at least in part, by gravitational forces, and a lifting mechanism configured to move the at least one breaker element away from the platform.

38 Claims, 7 Drawing Sheets

U.S. PATENT DOCUMENTS 6,186,311 B1 2/2001 Conner
6,382,425 B1 5/2002 Brickner et al.
6,499,681 B1 12/2002 Maruyama
6,540,166 B2 * 4/2003 Frick ..... 241/101.76

* cited by examiner 24
50
M
A
84
70
74
62
80
76
78
82
68
69
72
60
D
E
R
P
96
98
104
106
102
108
52
54
56
58
64
110
112
116
118
120

MATERIAL BREAKER SYSTEM

BACKGROUND

Various systems are used for processing dirt and/or debris mixtures, which may include rocks, concrete pieces, stumps, stones, discarded hardware, and other types of dirt and/or debris. That processing may include feeding and screening the dirt and/or debris mixtures into multiple piles. For example, one pile may contain essentially soil, and other piles may contain material of different sizes with at least some of those piles having commercial value as a recycled product. Examples of systems for processing dirt and/or debris mixtures are illustrated in U.S. Pat. No. 5,234,608 and U.S. patent application Ser. Nos. 10/971,355 and 11/053,729. The entire disclosures of that patent and those applications are herein incorporated by reference for all purposes.

Some debris mixtures may contain material of large sizes, such as large pieces of concrete, that need to be broken and/or crushed to have commercial value as a recycled product and/or for further processing. Various equipment may be used that breaks and/or crushes the material, usually while the material is on the ground. That broken and/or crushed material may then be fed into the processing system. Alternatively, a system may integrate the breaking and/or crushing of material with other processing equipment.

SUMMARY

Some embodiments provide a vehicle for breaking material. The vehicle includes: an elongate vehicle frame; a feeder having a feed end portion and a discharge end portion, wherein the feeder is configured to convey the material from the feed end portion to the discharge end portion; and a material breaker supported via the vehicle frame with a feed end portion that is downstream from the discharge end portion of the feeder. The material breaker includes: a platform configured to support the material received from the feeder, at least one breaker element configured to move towards the platform and contact at least a portion of the material received from the feeder and supported by the platform, wherein movement of the at least one breaker element towards the platform is assisted, at least in part, by gravitational forces, and a lifting mechanism configured to move the at least one breaker element away from the platform.

DETAILED DESCRIPTION

Figure 1:
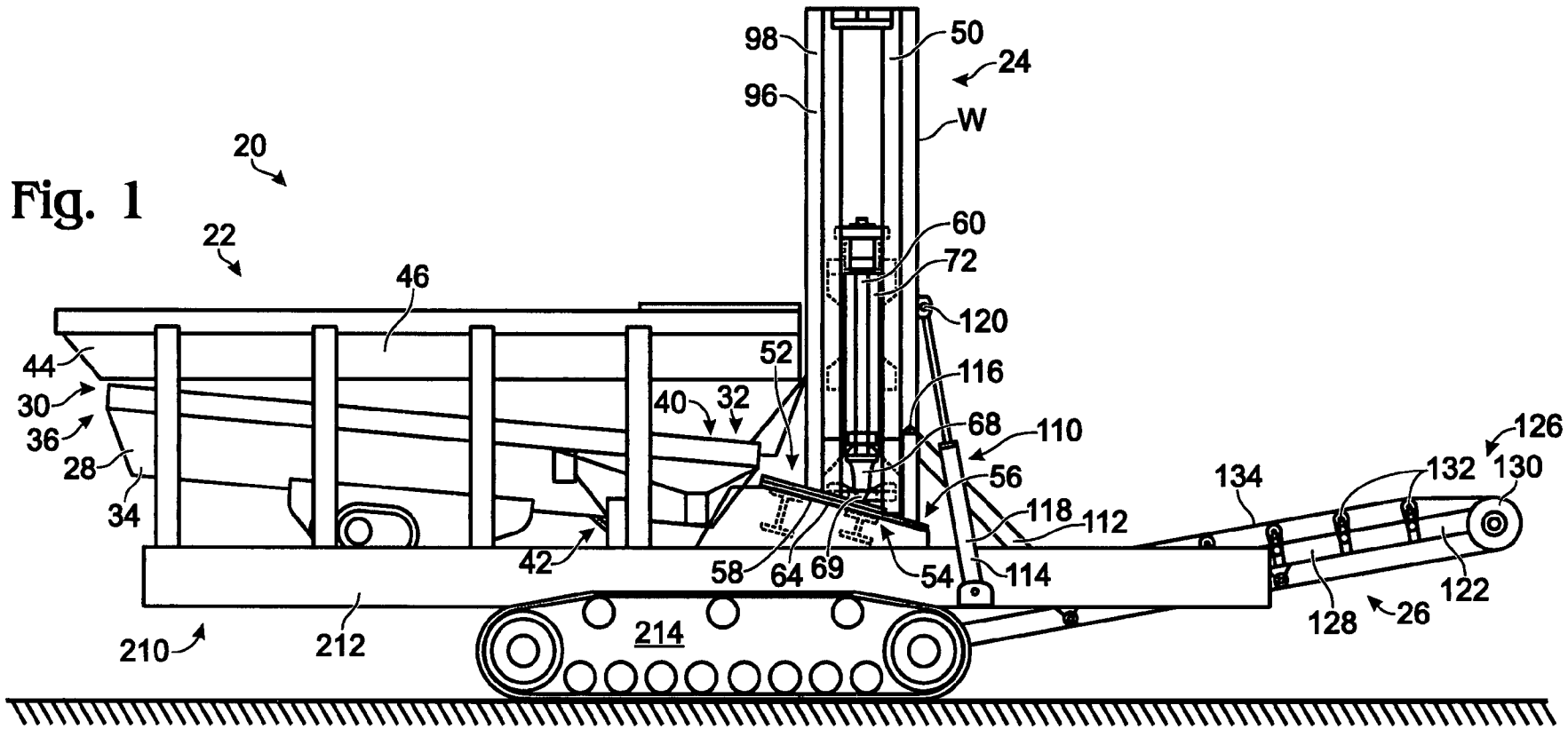
FIG. 1 is side view of a material breaker system mounted on a tracked vehicle frame with a material breaker in a working position.

FIG. 1 depicts some embodiments of a material breaker system 20. The material breaker system may be supported by a vehicle 210. Vehicle 210 may include an elongate vehicle frame 212. Additionally, transport tracks 214 may support the frame for movement over the ground.

Figure 2:
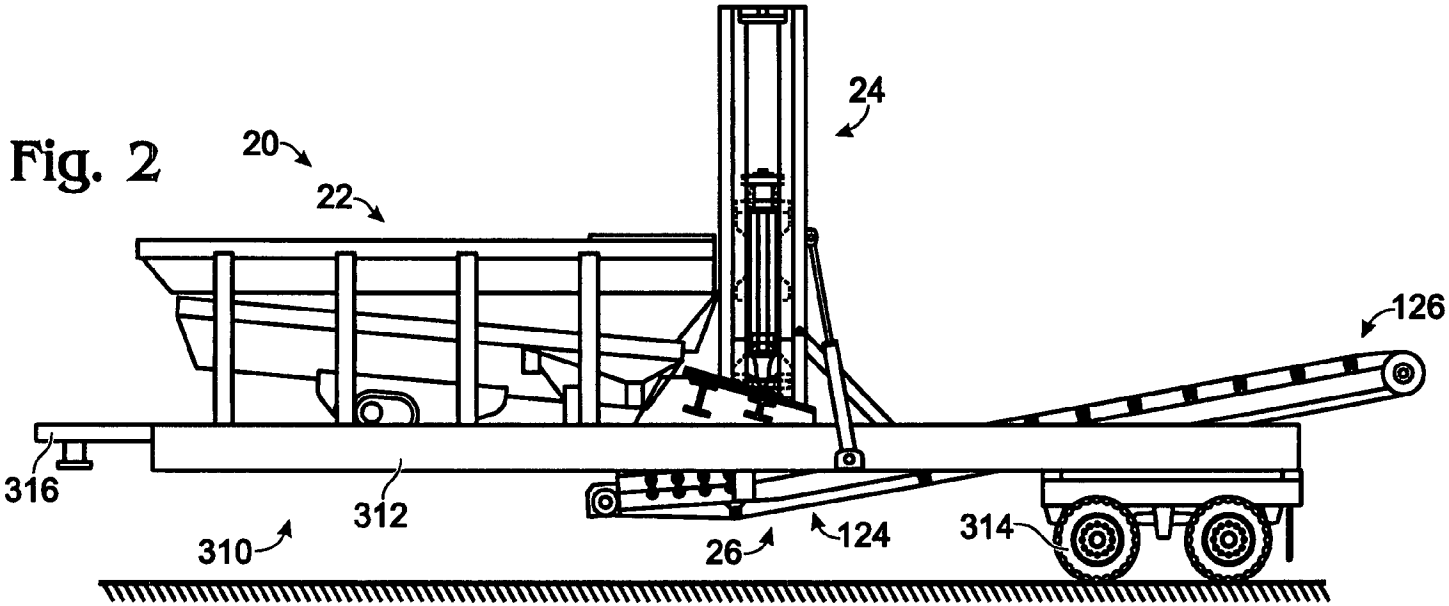
FIG. 2 is a side view of the material breaker system of FIG. 1 mounted on a wheeled vehicle frame.

Although material breaker system 20 is shown to be supported by a particular vehicle, the material breaker system may be supported by any suitable structure configured to enable the user to relocate and/or move the material breaker system to one or more desired locations. For example, material breaker system 20 may be mounted on a vehicle 310, as shown in FIG. 2. Vehicle 310 may include an elongate vehicle frame 312. Transport wheels 314 may support one end of the frame for movement over the ground, which is the rear end of the frame in the particular embodiment illustrated. The opposite end of the vehicle frame, which is the frame's forward end, may mount a hitch component 316, which may be connectable with suitable hitch structure at the rear of a drawing vehicle or tractor to ready the vehicle for movement as a trailer over a road or highway.

Figure 3:
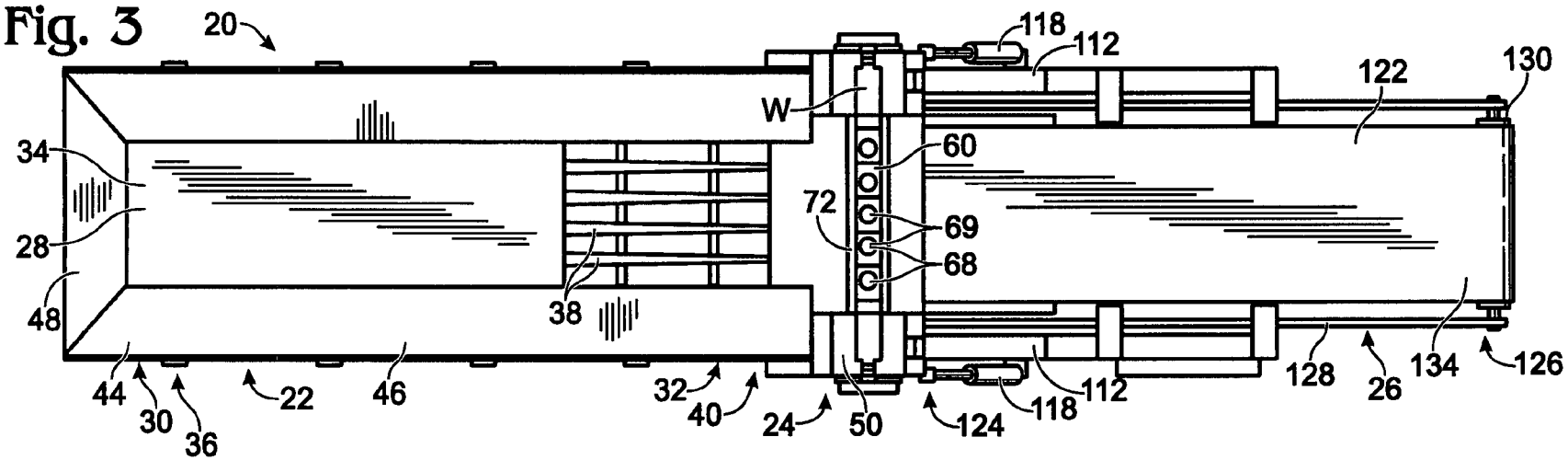
FIG. 3 is a top view of the material breaker system of FIG. 1 with the material breaker in the working position.

The material breaker system may include a feed structure 22, a breaker structure 24, and a conveying structure 26, as shown in FIGS. 1 and 3. Feed structure 22 may include any suitable structure configured to receive material and feed at least a portion of that material to breaker structure 24. For example, the feed structure may include a feeder 28 with a feed end portion 30 and a discharge end portion 32.

Feed structure 22 also may be configured to separate coarse material from material of smaller size, where the coarse material may be sent to the breaker structure and the material of smaller size may bypass the breaker structure. For example, feed structure 22 may include a vibrating grizzly feeder 34, which may include a feed end portion 36, grizzly bars 38, a first discharge end portion 40, and a second discharge end portion 42, as shown in FIGS. 1 and 3. The grizzly bars may be configured to allow material of smaller size to fall between the bars and to second discharge end portion 42, while moving coarse material to first discharge end portion 40. Vibrating grizzly feeder 34 also may include any suitable hydraulic system (not shown) or other drive system configured to selectively vibrate the feeder.

The vibrating grizzly feeder may be angled in any suitable way. For example, vibrating grizzly feeder 34 may be angled 5 degrees below a horizontal formed by a lower side of the hopper discussed below. Although the vibrating grizzly feeder is shown to be arranged at a certain angle, the feeder may be arranged at any suitable angle configured to facilitate movement of material from the feed end portion to the first discharge end portion and/or the second discharge end portion.

Although feed structure 22 is shown to include a vibrating grizzly feeder, any suitable feeder configured to receive material and feed at least a portion of that material to breaker structure 24 and/or to separate coarse material from material of smaller size may be used. For example, feeder 28 may be any suitable conveyor that receives material and feeds that material to breaker structure 24.

Feed structure 22 also may include a hopper 44, which includes any suitable structure configured to facilitate feeding material to feeder 28 and/or vibrating grizzly feeder 34. The hopper may include wing walls 46 and 48, which may be stationary or hinged. Although a particular hopper is depicted in FIGS. 1 and 3, any suitable hopper configured to facilitate feeding material to feeder 28 may be used.

Breaker structure 24 may include any suitable structure configured to break and/or crush at least a portion of the material received from feed structure 22. For example, the breaker structure may include a material breaker 50, as shown in FIGS. 1 and 3. Material breaker 50 may include a feed end portion 52, a breaking portion 54, and a discharge end portion 56. The feed end portion may be downstream from discharge end portion 32 of feeder 28 and/or downstream from first discharge end portion 40 of vibrating grizzly feeder 34. Additionally, the material breaker may include a material support structure 58, a breaker assembly 60, and a transport mechanism 62.

Material support structure 58 may include any suitable structure configured to support at least a portion of the material received from feed structure 22. For example, the material support structure may include a bed or platform 64. The bed or platform may be angled in any suitable way. For example, bed or platform 64 may be angled at 15 degrees from a horizontal formed by the top surface of the elongate vehicle frame. Although the bed or platform is shown to be angled at a certain degree, any suitable angle may be used configured to facilitate movement of material from feed end portion 52 to discharge end portion 56. Additionally, although material support structure 58 is shown to include a bed or platform, any suitable structure configured to support at least a portion of the material received from feed structure 22 may be used.

Figure 4:
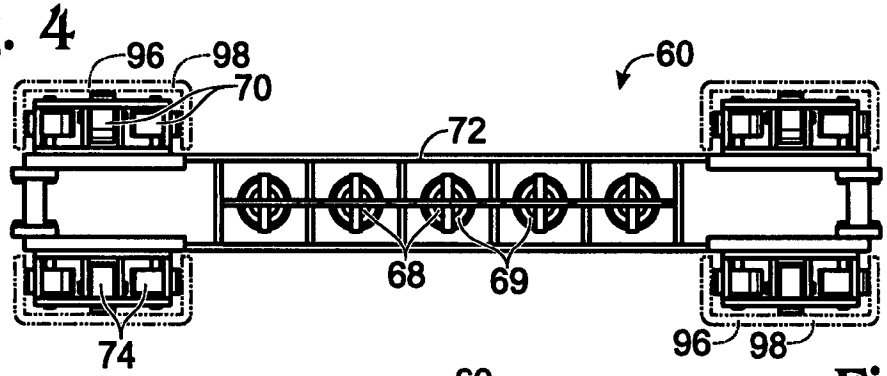
FIG. 4 is a top view of a breaker assembly used in the material breaker system of FIG. 1.
Figure 6:
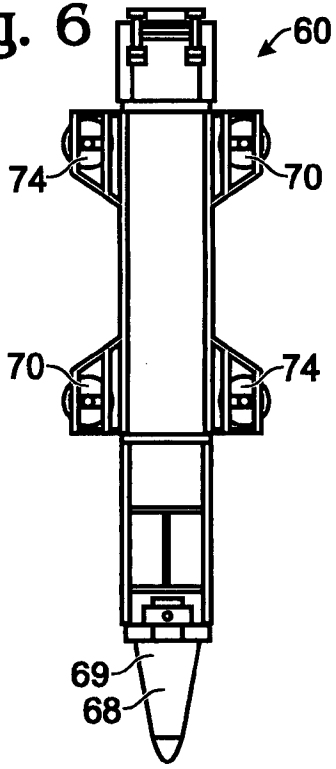
FIG. 6 is a side view of the breaker assembly used in the material breaker system of FIG. 1.
Figure 5:
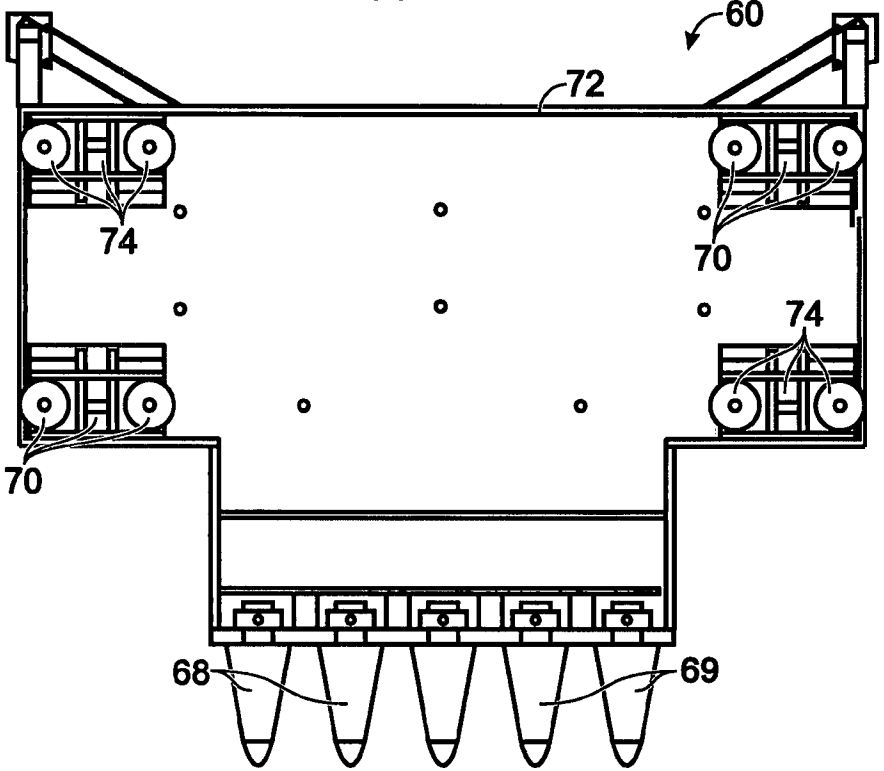
FIG. 5 is a front view of the breaker assembly used in the material breaker system of FIG. 1.

Breaker assembly 60 includes any suitable structure configured to contact material received from feed structure 22 and break and/or crush at least a portion of that material. For example, the breaker assembly may include at least one breaker element 68 and a frame 72, as shown in FIGS. 4-6. The breaker element may include any suitable structure configured to contact material received from feed structure 22 and break and/or crush at least a portion of that material. For example, breaker element 68 may include at least one hammer 69. Frame 72 may include any suitable structure configured to support the at least one breaker element. The breaker assembly may move towards the material support structure (such as from the distal position to the proximal position) and may contact material received from feed structure 22 via assistance, at least in part, by gravitational forces.

Alternatively, or additionally, breaker assembly 60 may move towards and/or away from the material support structure and/or the material received from feed structure 22 via any suitable hydraulic system or other drive system. Although the breaker element is shown to include hammer 69, any suitable structure configured to contact material received from feed structure 22 and break and/or crush at least a portion of that material may be used.

Figures 7, 8, 9:
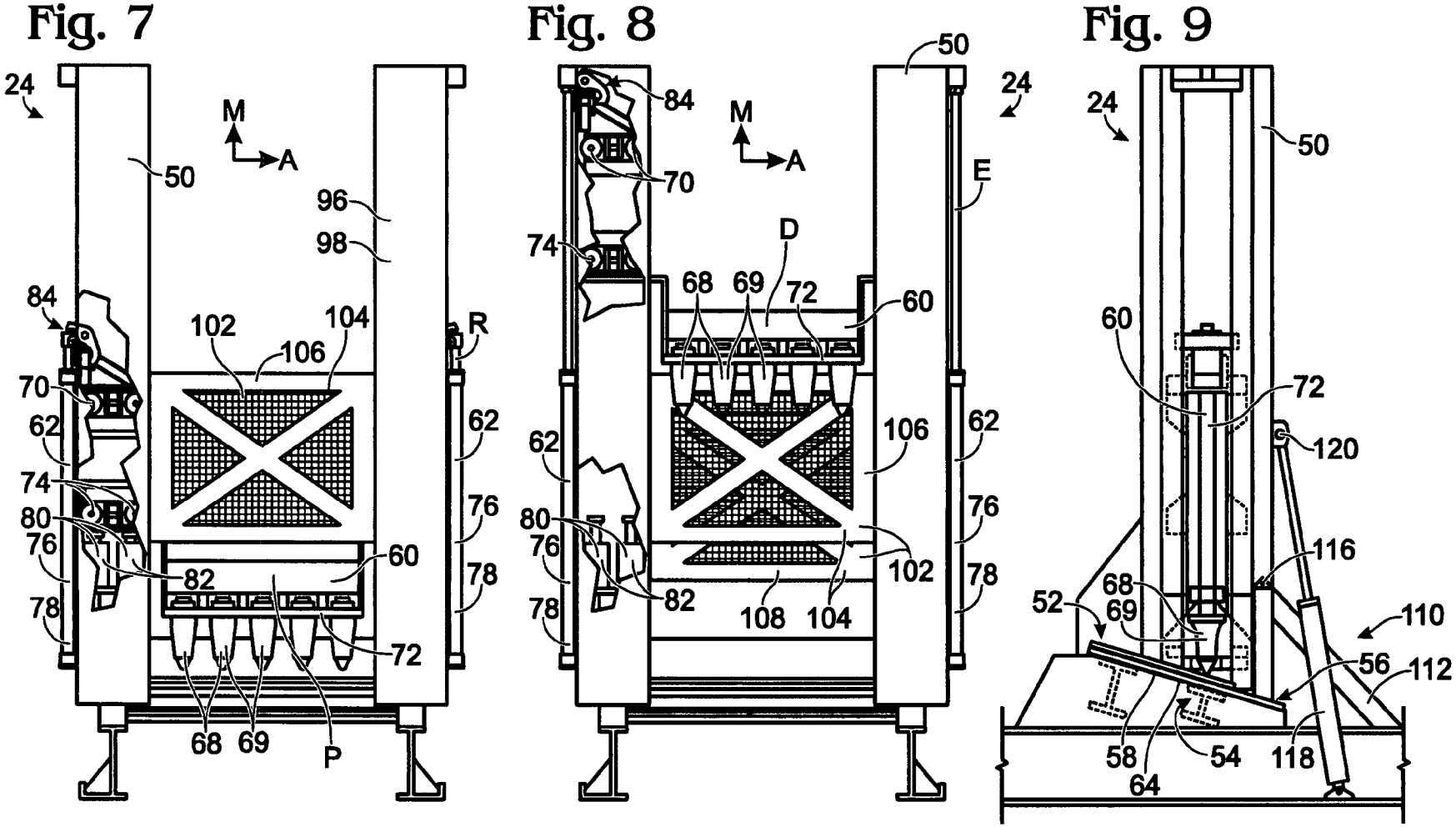
FIG. 7 is a front view of the material breaker used in the material breaker system of FIG. 1 showing the breaker assembly in a proximal position.
FIG. 8 is a front view of the material breaker used in the material breaker system of FIG. 1 showing the breaker assembly in a distal position.
FIG. 9 is a side view of the material breaker used in the material breaker system of FIG. 1 showing the breaker assembly in the proximal position.

In some embodiments, the breaker assembly may include at least three breaker elements, and in other embodiments at least five breaker elements, as shown in FIGS. 3-5. When three or more breaker elements are included, those elements may be arranged in a linear array. For example, the breaker elements may be arranged in a straight line along a first or arrangement axis A and may move along a second or movement axis M, which may be perpendicular to the arrangement axis, as shown in FIGS. 7-8. Breaker assembly 60 also may include at least one unlocking bracket 66, which may include any suitable structure configured to interact with the locking mechanism, as further discussed below.

Although the breaker assembly is shown to include five breaker elements, any suitable number of breaker elements may be used. Additionally, although the five breaker elements are shown to be arranged in a linear array, any suitable arrangement of breaker elements may be used, including staggered and/or non-linear arrangements. Moreover, although the breaker elements are shown to be arranged along an arrangement axis that is perpendicular to the axis the breaker elements move along, the breaker elements may be arranged in any suitable axis.

Additionally, breaker assembly 60 may include guide followers 70, which may include any suitable structure configured to maintain breaker assembly 60 along the guide structure discussed below. For example, guide followers 70 may include rollers 74, as shown in FIGS. 4-6. Any suitable combination of guide followers may be located at one or more suitable locations of breaker assembly 60. For example, three sets of rollers may be placed on eight corners on breaker assembly 60, as shown in FIGS. 4-6.

Although breaker assembly is shown to include twenty-four guide followers, any suitable number of guide followers configured to maintain the breaker assembly along the guide structure may be used. Additionally, although three sets of guide followers are placed on eight corners of breaker assembly 60, any suitable combination of guide followers may be placed in one or more suitable locations. Moreover, although guide followers 70 are shown to include rollers 74, any suitable structure configured to maintain the breaker assembly along the guide structure may be used. Furthermore, although breaker assembly 60 is shown to include specific structure, any suitable structure configured contact material received from feed structure 22 and break and/or crush at least a portion of that material may be used.

Transport mechanism 62 may include any suitable structure configured to move breaker assembly 60 towards and/or away from material support structure 58 and/or material received from feed structure 22. The transport mechanism may move breaker assembly between a distal position D, in which breaker assembly is spaced apart from the material support structure, and a proximal position P, in which breaker assembly 60 is adjacent the material support structure, as shown in FIGS. 7-8. Transport mechanism 62 may include a lifting mechanism 76. The lifting mechanism may be configured to move breaker assembly 60 away from the material support structure and/or the material received from feed structure 22.

Lifting mechanism 76 may include at least one telescoping cylinder 78 configured to selectively move between a retracted position R and an extended position E, thereby moving breaker assembly 60 between the proximal position and the distal position. For example, the telescoping cylinder may be in the retracted position when breaker assembly 60 is in the proximal position. Thus, movement of the telescoping cylinder from retracted position R to extended position E may move the breaker assembly from proximal position P to distal position D. Lifting mechanism 76 also may include any suitable hydraulic system (not shown) or other drive system configured to selectively move telescoping cylinder 78, thereby moving breaker assembly 60.

Although the lifting mechanism is shown to include two telescoping cylinders, any suitable number of telescoping cylinders or other suitable structure may be used. Additionally, although lifting mechanism is shown to include telescoping cylinders and drive systems, any suitable structure configured to selectively move breaker assembly 60 may be used. For example, rotary hydraulic cylinders, rotary pneumatic cylinders, servo motors, and rotary turntable systems may alternatively, or additionally, be used. Moreover, although the transport mechanism is shown to include a lifting mechanism, any suitable structure or mechanism configured to move breaker assembly 60 towards and/or away from material support structure 58 and/or material received from feed structure 22 may be used.

Material breaker 50 also may include at least one dampening mechanism 80, which may include any suitable structure configured to dampen breaker assembly 60 as it approaches the proximal position and/or to prevent the breaker assembly from contacting material support structure 58 (and potentially damaging the material support structure). For example, dampening mechanism 80 may include at least one shock absorber 82, as shown in FIGS. 7-8.

Although FIGS. 7-8 show two shock absorbers on the left side of the guide structure, it should be understood that there are two shock absorbers on the right side of the guide structure. Additionally, although material breaker 50 is shown and discussed to include four shock absorbers, any suitable number of shock absorbers may be used. Moreover, although dampening mechanism 80 is shown to include shock absorbers, any suitable structure configured to dampen breaker assembly 60 as it approaches the proximal position and/or to prevent the breaker assembly from contacting material support structure 58 may be used.

Additionally, material breaker 50 may include at least one locking mechanism 84, which may include any suitable structure configured to secure the breaker assembly to the lifting mechanism. The locking mechanism may include a first locking element 86 and a second locking element 88. The first locking element may include any structure configured to engage at least part of the second locking element and secure the breaker assembly to the lifting mechanism. For example, as shown in FIGS. 10-18, first locking element may include a latch 90, which may be connected to and/or supported via any suitable portion of lifting mechanism 76, such as an end of telescoping cylinder 78.

First locking element 86 may move between a locking position L, in which the first locking element engages at least part of the second locking element and secures the breaker assembly to the lifting mechanism, and an unlocking position U, in which the first locking element is spaced away from the second locking element such that the breaker assembly is free to move independent of the lifting mechanism. The first locking element may be configured to move to the unlocking position when breaker assembly 60 is in the distal position, as further discussed below. Although the first locking element is shown to include latch 90, any suitable structure configured to engage at least part of the second locking element may be used.

Figure 10:
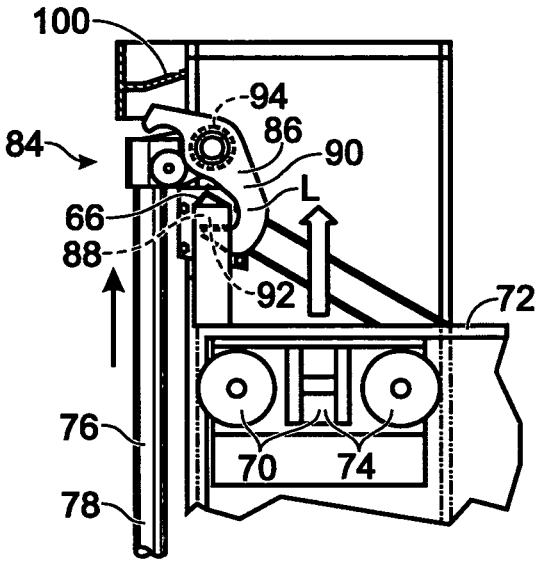
FIGS. 10-13 are partial views showing a locking mechanism releasing the breaker assembly of the material breaker system of FIG. 1.
Figure 11:
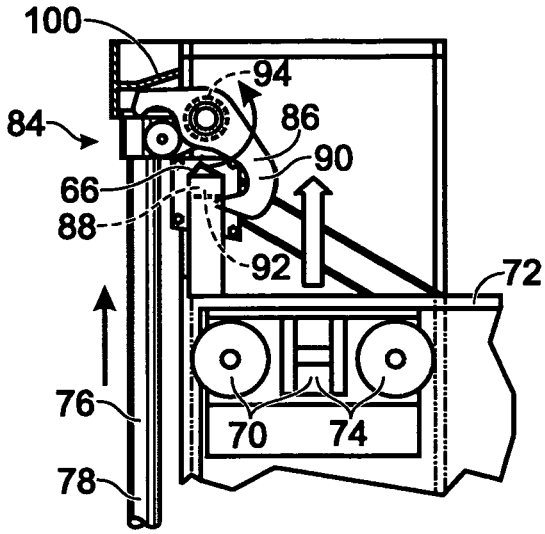
Figure 12:
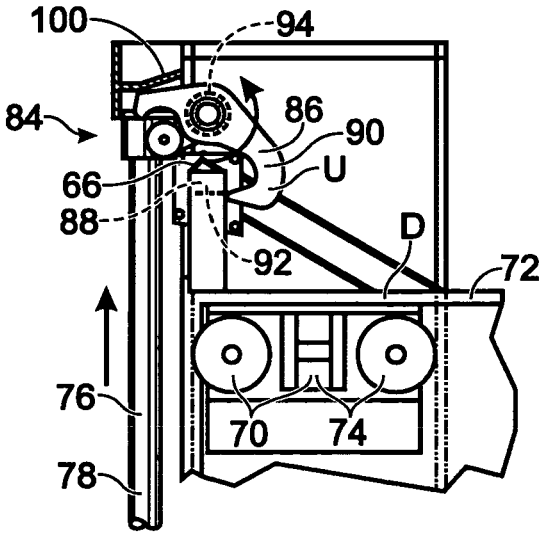
Figure 16:
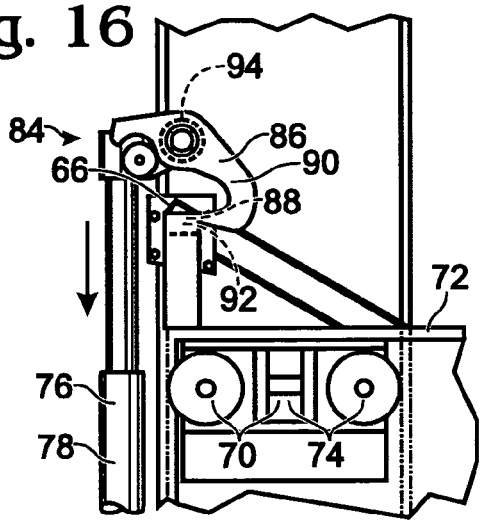
Figure 17:
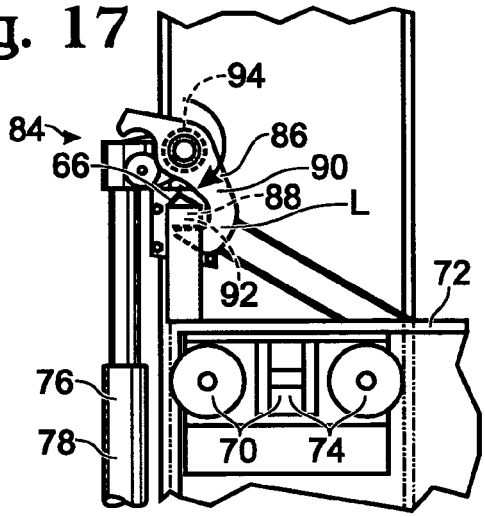
Figure 18:
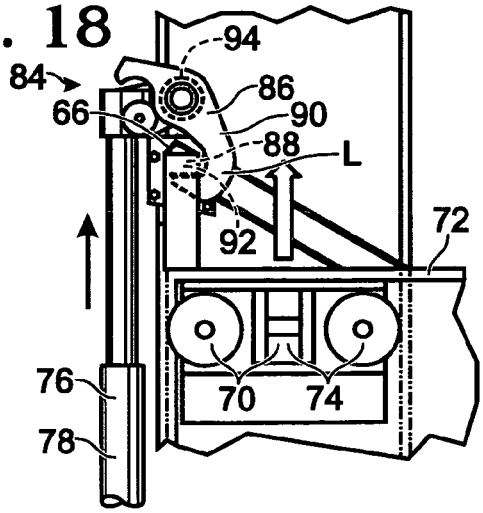

Second locking element 88 may include any suitable structure configured to engage at least part of the first locking element and secure the breaker assembly to the lifting mechanism. For example, second locking element 88 may include a tube 92, which may be connected to and/or supported via any suitable portion of breaker assembly 60. First locking element 86 engages at least part of second locking element 88 in the locking position, as shown in FIG. 10 and 17, to secure the breaker assembly to the lifting mechanism. In contrast, first locking element 86 is spaced away from second locking element 88 in the unlocking position, as shown in FIGS. 12 and 16, such that the breaker assembly is free to move independent of the lifting mechanism. Although second locking element is shown to include tube 92, any suitable structure configured to be engaged, at least in part, by first locking element 86 may be used.

Locking mechanism 84 also may include at least one bias element 94, as shown in FIGS. 10-18. The bias element may include any suitable structure configured to urge first locking element 86 towards the locking position and/or the unlocking position.

Although FIGS. 7-8 and 10-18 show one locking mechanism on the left side of the guide structure, it should be understood that there is at least another locking mechanism on the right side of the guide structure. Additionally, although the material breaker is shown and discussed to include two locking mechanisms, any suitable number of locking mechanisms may be included. Moreover, although locking mechanism 84 is shown to include the first and second locking elements, any suitable structure configured to secure the breaker assembly to the lifting mechanism may be used.

Figure 13:
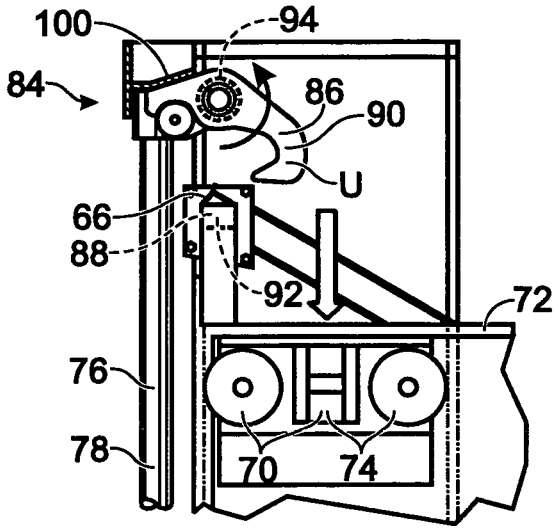
Figure 14:
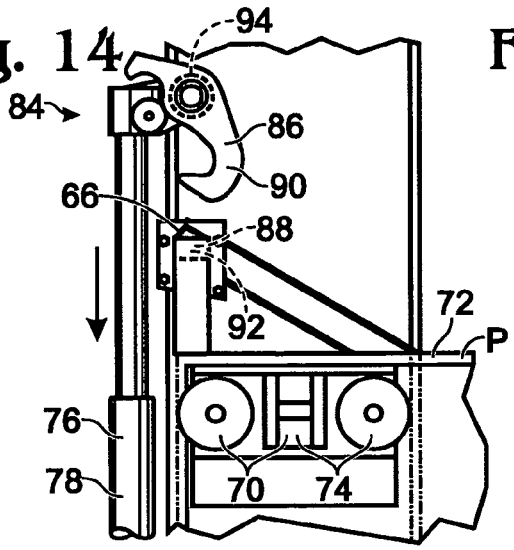
FIGS. 14-18 are partial views showing the locking mechanism engaging the breaker assembly of the material breaker system of FIG. 1.
Figure 15:
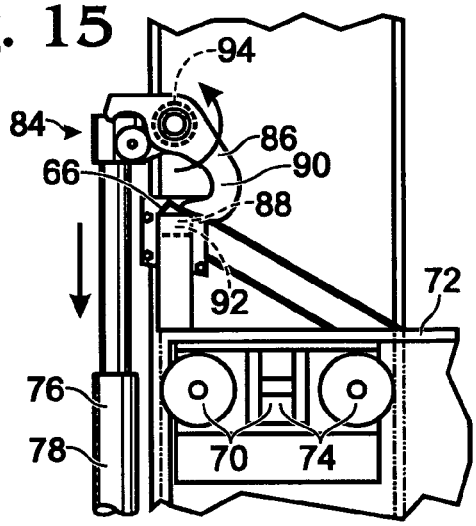

As discussed above, unlocking bracket 66 of breaker assembly 60 may include any suitable structure configured to interact with locking mechanism 84. For example, unlocking bracket 66 may include any suitable structure configured to move first locking element 86 towards the unlocking position, as shown in FIGS. 13-14. Although a specific structure is shown for unlocking bracket 66, any suitable structure configured to move the first locking element towards the unlocking position may be used. Moreover, although unlocking bracket is shown to be part of breaker assembly 60, the unlocking bracket may be part of any suitable component of the material breaker system.

Additionally, material breaker 50 may include a guide structure 96, which may include any suitable structure configured to guide at least part of the movement of breaker assembly 60 between the proximal position and the distal position. For example, guide structure 96 may include a linear track 98 configured to guide at least part of the movement of breaker assembly 60 to move linearly towards and/or away from material support structure 58. Although guide structure 96 is shown to include a linear track, any suitable linear, non-linear, or any suitable combination structure may be used configured to guide at least part of the movement of breaker assembly 60 between the proximal position and the distal position.

Guide structure 96 may include at least one unlocking bracket 100, which may include any suitable structure configured to move first locking element 86 from the locking position towards the unlocking position when breaker assembly 60 is spaced away from material support structure 58, such as when the breaker assembly is at the distal position. Movement of the first locking element to the unlocking position allows the breaker assembly to move independent of the lifting mechanism. Although a specific structure is shown for unlocking bracket 100, any suitable structure configured to move the first locking element towards the unlocking position may be used. Additionally, although unlocking bracket 100 is shown to be part of guide structure 96, the unlocking bracket may be part of any suitable component of the material breaker system. Furthermore, although the material breaker is shown to include a guide structure, the material breaker may be configured to operate without any guide structure.

Figure 20:
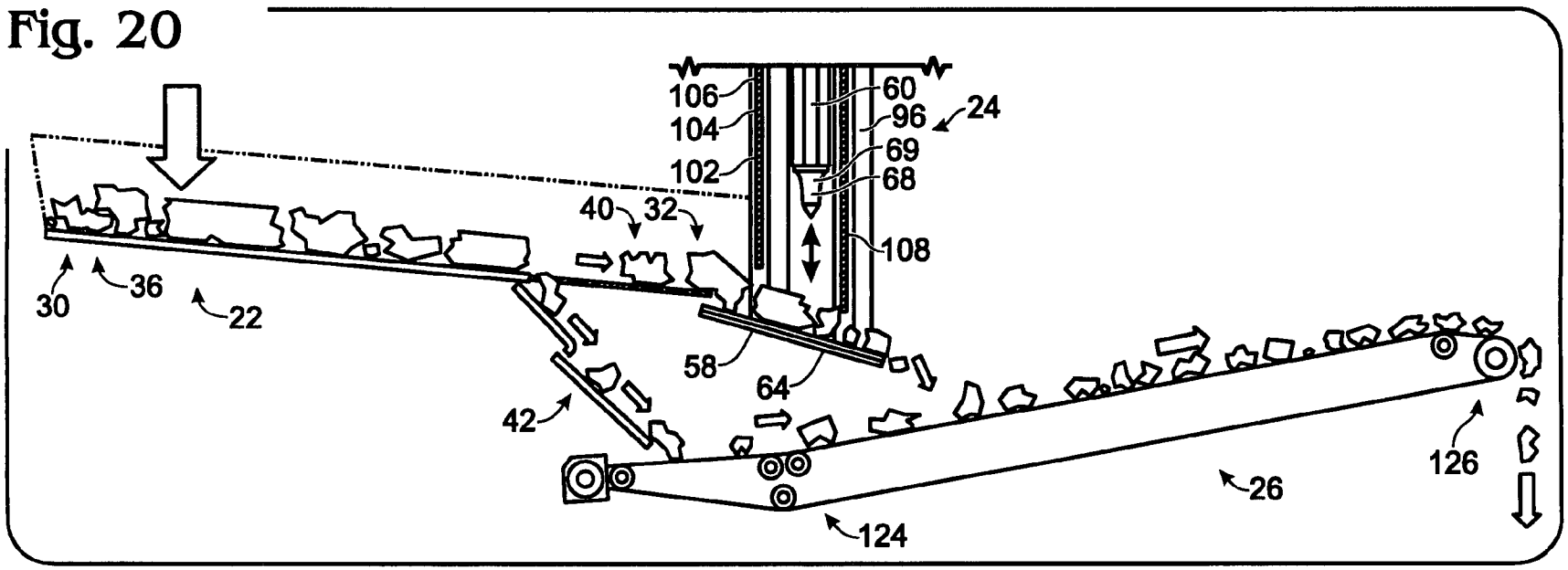
FIG. 20 is a partial schematic view of the material breaker system of FIG. 1 shown without the vehicle frame to illustrate material flow through the system.

Moreover, material breaker 50 may include at least one material regulator 102, which may include any suitable structure configured to regulate the size of material entering and/or exiting the material breaker. For example, the material regulator may include at least one gate 104. Furthermore, any suitable number of material regulators may be used. For example, material breaker 50 may include a first material regulator 106, which may be located adjacent the feed end portion of the material breaker, as shown in FIGS. 7-8 and 20. The first material regulator may be configured to limit the size of material downstream of the feed end portion of the material breaker. First material regulator 106 may thus be configured to prevent material exceeding a certain size from going to the breaking portion of the material breaker. That size may be based, at least in part, on the breaking capacity of the breaker assembly.

Additionally, material breaker 50 may include a second material regulator 108, which may be located adjacent the discharge end portion of the material breaker, as shown in FIGS. 8 and 20. The second material regulator may be configured to limit the size of the material in the discharge end portion of the material breaker. Second material regulator 108 may thus be configured to confine the material to the breaking portion of the material breaker until the material is less than a certain size. That size may be based, at least in part, on processing requirements and/or goals.

Although material regulator 102 is shown to include gate 104, any suitable structure configured to regulate the size of material entering and/or exiting the material breaker may be used. Additionally, although breaker structure 24 is shown to include the material breaker, any suitable structure configured to break and/or crush at least a portion of the material received from feed structure 22 may be used.

Figure 19:
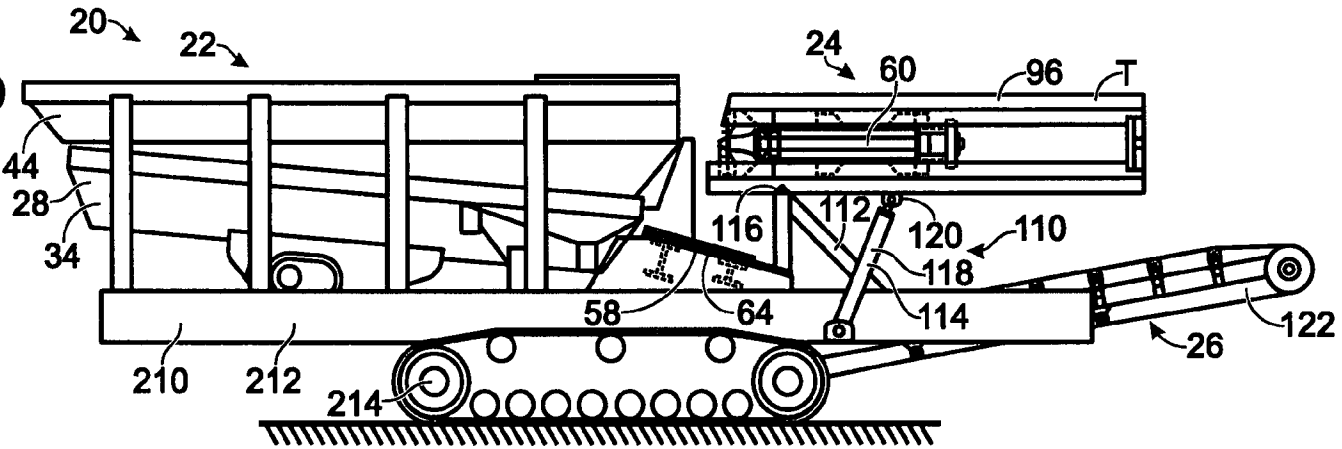
FIG. 19 is a side view of the material breaker system of FIG. 1 showing the material breaker in a travel position.

Breaker structure 24 also may be adjustable between a working position W, as shown in FIGS. 1 and 3, and a travel position T, as shown in FIG. 19. The material breaker may be configured to break and/or crush material received from feed structure 22 in the working position, while at least part of the material breaker may be stowed for ease of travel in the travel position. The breaker structure may include any suitable structure configured to provide adjustability between the working and travel positions. For example, breaker structure 24 may include a support assembly 110 configured to provide adjustability between those positions and/or support at least some of the components of the material breaker.

Support assembly 110 may include at least one support element 112 and at least one pivoting connector 114, as shown in FIGS. 1 and 3. The support element may include any suitable structure configured to support at least some of the components of material breaker 50. Support element 112 may be pivotally connected to at least some of the components of material breaker 50. For example, the support element may be pivotally connected to guide structure 96 via hinge connections 116.

Pivoting connector 114 may include any suitable structure configured to support and/or pivot at least some of the components of material breaker 50 between the working position and the travel position. For example, pivoting connector 114 may include at least one telescoping cylinder 118 configured to pivot guide structure 96. The telescoping cylinder may be pivotally connected to guide structure 96 via hinge connections 120. Pivoting connector 114 may be connected to any suitable hydraulic system (not shown) or other drive system configured to selectively move the telescoping cylinder thereby pivoting at least some of the components of material breaker 50.

Additionally, support assembly 110 may include at least one locking mechanism (not shown), which may include any suitable structure configured to lock material breaker 50 in the working position and/or the travel position. Although support assembly 110 is shown to include two support elements and two pivoting connectors, any suitable number of support elements and/or pivoting connectors may be used. Moreover, although support assembly 110 is shown to include support elements and pivoting connectors, any suitable structure configured to support and/or pivot at least some of the components of material breaker 50 between the working position and the travel position may be used. For example, rotary hydraulic cylinders, rotary pneumatic cylinders, servo motors, and rotary turntable systems may alternatively, or additionally, be used.

Conveying structure 26 may include any suitable structure configured to receive material from breaker structure 24 (such as from discharge end portion 56) and/or feed structure 22 (such as from second discharge end portion 42), and convey that material to one or more desired locations. For example, the conveying structure may include a conveyor 122 with a feed end portion 124 and a discharge end portion 126, as shown in FIGS. 1 and 2. The conveyor may include an elongate frame 128, end rolls 130, rollers 132, and a conveyor belt 134. Conveyor belt 134 moves in a direction from feed end portion 124 to discharge end portion 126 and may be made of any suitable material configured to flex and remain operatively connected to conveyor 122. Any suitable drive system may be used configured to move conveyor belt 134.

Conveying structure also may include a hopper and/or skirts (not shown) configured to facilitate movement of material. Although conveying structure 26 is shown to include a conveyor, the conveying structure may include any suitable structure configured to receive material from the breaker structure and/or the feed structure and convey that material to one or more desired locations.

In operation, material may be loaded to the feed end portion of feed structure 22, as shown in FIG. 20. The feed structure may convey coarse material to first discharge end portion 40 and/or may convey material of smaller size to second discharge end portion 42. Breaker structure 24 may receive material from first discharge end portion 40 of feed structure 22 and may break and/or crush at least a portion of that material.

Breaker structure 24 may be cyclically operated, as shown in FIGS. 7-8 and 10-18. The telescoping cylinder of lifting mechanism 76 may move to extended position E, which may move breaker assembly 60 to distal position D. Upon reaching the distal position, unlocking bracket 100 of guide structure 96 may move first locking element 86 towards the unlocking position (which may oppose the urging of bias element 94 towards the locking position), as shown in FIGS. 10-13. The breaker assembly may then move towards proximal position P and contact the material received from feed structure 22 independent of the lifting mechanism. That movement of the breaker assembly may be assisted, at least in part, by gravitational forces. Breaker assembly 60 may break and/or crush at least a portion of the material the breaker assembly contacts.

The telescoping cylinder of lifting mechanism 76 may move towards retracted position R with bias element urging the first locking element to the locking position. As the cylinder approaches the retracted position, unlocking bracket 66 of breaker assembly 60 may move first locking element 86 towards the unlocking position allowing the first element to engage at least a portion of second locking element 88, as shown in FIGS. 14-18. With the breaker assembly secured to the lifting mechanism, that mechanism may then move the breaker assembly to the distal position again to repeat the cycle. The breaker assembly may be cyclically operated at any suitable frequency, such as 12 strokes per minute. Alternatively, the breaker structure may be operated on an as-needed basis, or any suitable combination of cyclical and as-needed operation.

The broken material from breaker structure 24 may be discharged to the feed end portion of conveying structure 26. That feed end portion also may receive material from the second discharge end portion of feed structure 22. The conveying structure may then transport or convey material received from breaker structure 24 and/or feed structure to discharge end portion 126.

When the material breaker system needs to be moved or relocated, the system may be adjusted to the travel position. First, any suitable locking mechanism used to lock the material breaker in the working position may be unlocked. Second, pivoting connector 114 may be operated to pivot at least some of the components of the material breaker to the travel position. Finally, any suitable locking mechanism may be used to lock the material breaker in the travel position. To adjust the material breaker system from the travel position to the working position, the steps above may simply be reversed. The steps discussed above related to operation and adjustment of the material breaker between the working and travel positions may be performed in different sequences and in different combinations, not all steps being required for all embodiments of the material breaker system.

Although the material breaker system and features of the material breaker system have been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

We claim:

1. A vehicle for breaking material, comprising:

an elongate vehicle frame;

a feeder having a feed end portion and a discharge end portion, wherein the feeder is configured to convey the material from the feed end portion to the discharge end portion; and a material breaker supported via the vehicle frame with a feed end portion that is downstream from the discharge end portion of the feeder, wherein the material breaker includes:

a platform configured to support the material that is received from the feeder, at least one breaker element configured to move away from the platform, and to move towards the platform to contact at least a portion of the material that is received from the feeder and is supported by the platform, and a lifting mechanism including at least one telescoping cylinder operatively connected to the at least one breaker element, wherein the at least one telescoping cylinder is configured to move the at least one breaker element away from the platform, and to allow gravitational forces to move the at least one breaker element towards the platform to contact the at least a portion of the material that is received from the feeder and is supported by the platform.

2. The vehicle of claim 1, wherein the material breaker is adjustable between a working position and a travel position.

3. The vehicle of claim 1, wherein the material breaker includes a locking mechanism configured to secure the at least one breaker element to the lifting mechanism for movement away from the platform, wherein the locking mechanism includes a first locking element supported via the lifting mechanism, and a second locking element supported via the at least one breaker element.

4. The vehicle of claim 3, wherein the first locking element is configured to move between a locking position, in which the first locking element engages at least part of the second locking element, and an unlocking position, in which the first locking element is spaced away from the second locking element.

5. The vehicle of claim 4, wherein the locking mechanism includes at least one bias element configured to bias the first locking element towards the locking position.

6. The vehicle of claim 4, wherein the first locking element is configured to move to the unlocking position when the at least one breaker element is spaced away from the platform.

7. The vehicle of claim 1, wherein the material breaker includes a linear track configured to guide at least part of the movement of the at least one breaker element between a proximal position and a distal position.

8. The vehicle of claim 7, wherein the at least one telescoping cylinder is further configured to moved the at least one breaker element to the distal position, and to allow gravitational forces to move the at least one breaker element towards the proximal position.

9. The vehicle of claim 8, wherein the material breaker includes a locking mechanism configured to secure the at least one breaker element to the lifting mechanism for movement to the distal position, wherein the locking mechanism includes a first locking element supported via the lifting mechanism, and a second locking element supported via the at least one breaker element.

10. The vehicle of claim 9, wherein the first locking element is configured to move between a locking position, in which the first locking element engages at least part of the second locking element, and an unlocking position, in which the first locking element is spaced away from the second locking element.

11. The vehicle of claim 10, wherein the locking mechanism includes at least one bias element configured to bias the first locking element towards the locking position.

12. The vehicle of claim 10, wherein the linear track is configured to move the first locking element to the unlocking position when the at least one breaker element is in the distal position.

13. The vehicle of claim 1, wherein the material breaker includes at least three breaker elements.

14. The vehicle of claim 13, wherein the at least three breaker elements are arranged in a linear array.

15. The vehicle of claim 14, wherein the at least three breaker elements are arranged in a straight line along a first axis, wherein the at least three breaker elements move along a second axis, and wherein the first axis is perpendicular to the second axis.

16. The vehicle of claim 13, wherein the material breaker includes at least five breaker elements.

17. The vehicle of claim 16, wherein the at least five breaker elements are arranged in a linear array.

18. The vehicle of claim 1, wherein the material breaker includes a first material regulator located adjacent the feed end portion of the material breaker and configured to limit the size of the material downstream of the feed end portion of the material breaker.

19. The vehicle of claim 18, wherein the material breaker includes a second material regulator located adjacent a discharge end portion of the material breaker and configured to limit the size of the material in the discharge end portion of the material breaker.

20. The vehicle of claim 1, wherein the feeder includes a first discharge end portion and a second discharge end portion.

21. The vehicle of claim 20, wherein the feeder is configured to convey coarse material from the feed end portion to the first discharge end portion, and to convey material of smaller size from the feed end portion to the second discharge end portion.

22. A vehicle for breaking material, comprising:

an elongate vehicle frame;

a feeder having a feed end portion and a discharge end portion, wherein the feeder is configured to convey material from the feed end portion to the discharge end portion;

a material breaker supported via the vehicle frame with a feed end portion that is downstream from the discharge end portion of the feeder, wherein the material breaker includes a platform configured to support the material that is received from the feeder, and a linear array of at least three breaker elements configured to move linearly away from the platform, and to linearly move towards the platform to contact at least a portion of the material that is received from the feeder and is supported by the platforms; and a lifting mechanism including at least one telescoping cylinder operatively connected to the linear array of at least three breaker elements, wherein the at least one telescoping cylinder is configured to move the linear array of at least three breaker elements away from the platform, and to allow gravitational forces to move the linear array of at least three breaker elements towards the platform to contact the at least a portion of the material that is received from the feeder and is supported by the platform.

23. The vehicle of claim 22, wherein the material breaker is adjustable between a working position and a travel position.

24. The vehicle of claim 22, wherein the material breaker includes a locking mechanism configured to secure the linear array of at least three breaker elements to the lifting mechanism for movement away from the platform, wherein the locking mechanism includes a first locking element supported via the lifting mechanism, and a second locking element supported via the linear array of at least three breaker elements, and wherein the first locking element is configured to move between a locking position, in which the first locking element engages at least part of the second locking element, and an unlocking position, in which the first locking element is spaced away from the second locking element.

25. The vehicle of claim 24, wherein the first locking element is configured to move to the unlocking position when the linear array of at least three breaker elements is spaced away from the platform.

26. The vehicle of claim 22, wherein the linear array includes at least five breaker elements.

27. The vehicle of claim 22, wherein the material breaker includes a first material regulator located adjacent the feed end portion of the material breaker and configured to limit the size of the material downstream of the feed end portion of the material breaker, and a second material regulator located adjacent a discharge end portion of the material breaker and configured to limit the size of the material in the discharge end portion of the material breaker.

28. The vehicle of claim 22, wherein the feeder includes a first discharge end portion and a second discharge end portion, and wherein the feeder is configured to convey coarse material from the feed end portion to the first discharge end portion, and to convey material of smaller size from the feed end portion to the second discharge end portion.

29. A vehicle for breaking material, comprising:

an elongate vehicle frame;

a feeder having a feed end portion, a first discharge end portion, and a second discharge end portion, wherein the feeder is configured to convey coarse material from the feed end portion to the first discharge end portion, and to convey material of smaller size from the feed end portion to the second discharge end portion;

a material breaker supported via the vehicle frame with a feed end portion that is downstream from the first discharge end portion of the feeder, wherein the material breaker includes:

at least one breaker element configured to move away from the material that is received from the feeder, and to move towards and contact at least a portion of the material that is received from the feeder, and a lifting mechanism including at least one telescoping cylinder operatively connected to the at least one breaker element, wherein the at least one telescoping cylinder is configured to move the at least one breaker element away from the material that is received from the feeder, and to allow gravitational forces to move the at least one breaker element towards the material that is received from the feeder to contact the at least a portion of the material that is received from the feeder, wherein the material breaker is adjustable between a working position and a travel position; and a conveyor having a feed end portion that is downstream from the second discharge end of the feeder and a discharge end portion of the material breaker.

30. The vehicle of claim 29, wherein the material breaker includes a linear track configured to guide at least part of the movement of the at least one breaker element between a proximal position and a distal position.

31. The vehicle of claim 30, wherein the material breaker includes a locking mechanism configured to secure the at least one breaker element to the lifting mechanism for movement to the distal position, wherein the locking mechanism includes a first locking element supported via the lifting mechanism, and a second locking element supported via the at least one breaker element, and wherein the first locking element is configured to move between a locking position, in which the first locking element engages at least part of the second locking element, and an unlocking position, in which the first locking element is spaced away from the second locking element.

32. The vehicle of claim 31, wherein the linear track is configured to move the first locking element to the unlocking position when the at least one breaker element is in the distal position.

33. The vehicle of claim 29, wherein the material breaker includes at least three breaker elements.

34. The vehicle of claim 33, wherein the at least three breaker elements are arranged in a linear array.

35. The vehicle of claim 33, wherein the material breaker includes at least five breaker elements.

36. The vehicle of claim 35, wherein the at least five breaker elements are arranged in a linear array.

37. The vehicle of claim 29, wherein the material breaker includes a first material regulator located adjacent the feed end portion of the material breaker and configured to limit the size of the material downstream of the feed end portion of the material breaker.

38. The vehicle of claim 37, wherein the material breaker includes a second material regulator located adjacent a discharge end portion of the material breaker and configured to limit the size of the material in the discharge end portion of the material breaker.

* * * * *